US006460657B1

(12) United States Patent
Isenburg et al.

(10) Patent No.: US 6,460,657 B1
(45) Date of Patent: Oct. 8, 2002

(54) CONVEYOR APPARATUS FOR OPEN-CUT MINING

(75) Inventors: Werner Isenburg, Erndtebrück; Paul-Gerhard Lütticke, Siegen; Folker Rollmann, Netphen; Walter Schröder, Wilnsdorf; Wolfgang Schubert; Klaus Simmich, both of Netphen, all of (DE)

(73) Assignee: Siemag Transplan GmbH, Netphen (DE)

( * ) Notice: Subject to any disclaimer, the term of this patent is extended or adjusted under 35 U.S.C. 154(b) by 0 days.

(21) Appl. No.: 09/488,965

(22) Filed: Jan. 21, 2000

(30) Foreign Application Priority Data

Jan. 22, 1999 (DE) ..... 199 02 447
Dec. 29, 1999 (DE) ..... 199 63 464

(51) Int. Cl.[7] ..... B66B 9/16

(52) U.S. Cl. ..... 187/245; 187/246; 187/254; 414/595

(58) Field of Search ..... 414/595, 602; 187/245, 246, 254, 266

(56) References Cited

U.S. PATENT DOCUMENTS 266,301 A * 10/1882 Morris ..... 187/245
774,387 A * 11/1904 Heffrin ..... 187/245
822,153 A * 5/1906 Robertson ..... 187/245
2,546,991 A * 4/1951 Evans et al. ..... 187/245
4,026,388 A * 5/1977 Creissels ..... 187/245
4,979,593 A * 12/1990 Watanabe et al. ..... 187/12
5,125,481 A * 6/1992 Shibata ..... 187/12

FOREIGN PATENT DOCUMENTS

FR 2640604 * 12/1988 ..... B66B/11/08

OTHER PUBLICATIONS

D11, Jan. 1987, Elevator Mechanical Design.*

* cited by examiner

*Primary Examiner*—Christopher P. Ellis
*Assistant Examiner*—Rashmi Sharma
(74) *Attorney, Agent, or Firm*—Herbert Dubno

(57) ABSTRACT

An inclined elevator for excavating an open cut mine in stopes has a traveling platform and counterweight coupled by cables whose upper and lower passes extend over upper and lower cable pulleys to the drum of a conveyor or drive machine. The cables can pass around a rerouting pulley which can be shifted on the foundation for the inclined elevator to compensate for increased depth of the excavation. The traveling platform which carries the car or truck for the mined material can have pins engaging in a bottom which is removable from the platform and can be locked in upper and lower positions relative to the foundation by pawls engaging in notches or recesses of the bottom.

11 Claims, 14 Drawing Sheets

CONVEYOR APPARATUS FOR OPEN-CUT MINING

FIELD OF THE INVENTION

Our present invention relates to a conveyor apparatus for open-cut mining and especially for removal of the overburden and mine deposits in the formation of stopes in a step-like manner with progressively increasing widening of the excavation with increasing excavation depth.

BACKGROUND OF THE INVENTION

In open-cut mining the overburden and mine deposits are removed in a step-like formation, i.e. with the formation of stopes. The depth of the excavation continuously increases and with increasing depth, there is an increased widening of the funnel-shaped opening of the excavation. The excavator is usually moved along a bottom of the excavation to form a stope and, depending upon the stability of the ground, the equipment used and economic conditions, the stope height can average around 15 m and for the removal of the loose material, the inclined planes between the stopes serve as roads along which the excavated material is removed. The deeper the deposit being mined, the wider must be the opening of the cut by a factor of 400 to 600, thereby defining the funnel shape of the excavation. Material loosened by drilling or explosives (hard rock and solid ores) as well as the overburden are transported away as a rule in trucks formed as trough tippers, mine cars and the like. These trucks travel from the stopes to the grade surface or ground level along the road. The serpentine path increases with mining depth and the travel can be at a speed of about 10 Km/h upwardly and about 35 Km/h downwardly. This requires high concentration of the part of the vehicle drivers and always creates the possibility of accidents.

OBJECTS OF THE INVENTION

It is the principal object of the present invention to provide a conveyor apparatus which can carry out mined material including the mined deposit and the overburden from locations in an open-cut mining operation to the surface in a more economical and reliable manner without significant cost.

Another object of the invention is to provide an apparatus for this purpose which allows adjustment to increasing mining depths.

It is also an object of this invention to provide a conveyor apparatus for open-cut mining in a funnel-shaped excavation with removal of overburdened mined deposits, formations of stopes and increased width at an opening of the funnel-shaped excavation at grade level with increased excavation depth, whereby the drawbacks of earlier excavation techniques are avoided, long transport distances are eliminated and the danger of accidents is minimized.

Still another object of this invention is to provide an improved apparatus which obviates the drawbacks of earlier excavation systems.

SUMMARY OF THE INVENTION

The objects are attained, in accordance with the invention in a conveyor apparatus for the purposes described and which can be advanced downwardly for increasing depth of excavation. The conveyor apparatus of the invention comprises:

an inclined elevator extending from an edge of the opening at grade level to the floor level;

a traveling platform riding on the inclined elevator and adapted to receive a truck to be filled with overburden or mined deposits;

at least one cable passing over separate upper and lower cable pulleys and having an upper pass of the cable extending to the upper cable pulley from the traveling platform and a lower pass of the cable extending from the lower cable pulley along the elevator;

a counterweight riding on the elevator and connected to the lower pass of the cable; and a conveyor mechanism operating at grade level at an upper end of the elevator and having a cable drum looped by a portion of the cable between the upper and lower cable pulleys.

According to the invention, therefore, an elevator along which trucks for receiving the mined material can be guided is provided to extend from an edge of the opening of the funnel-shaped excavation at grade level to a floor level at which excavation is carried out and preferably to the bottom of the cut. At least one cable is provided which has upper and lower passes extending over respective cable pulleys with the upper pass of the cable being affixed to a platform on which the car, usually a trough tripper or dumpable car can be carried while the lower pass of the cable is affixed to a counterweight. Both the platform and the upper weight are being guided along the inclined conveyor.

At grade level the cable passes around a conveyor mechanism or machine. The mined material carried by the car or truck is thus transported along the elevator in an upward direction to the edge of the cut.

Because of the inclination of the conveyor which can correspond to the inclination of the funnel-shaped excavation, e.g. even with increasing mining depth, and by elimination of the serpentine path which the cars or truck had to travel previously from the bottom of the excavation to the top thereof, the distance which the trucks travel is minimized thereby simplifying the operations and minimizing the burden placed on the trucks or cars.

A loaded truck or car at the bottom of the excavation need only be placed on the platform in its lowered position, secured in place with appropriate arresting means and then transported driverlessly to the surface at which point another driver can take over control and transport of the car or truck. The result is a highly flexible, economical usage of personnel since different individuals can be provided at the surface and at the floor of the excavation for transport purposes.

Since the counterweight moves in a direction opposite the platform and balances the comparatively high weight of the platform and the loaded car, which may amount to about 500 metric tons, the net mass which must be displaced by the input of energy can be only a fraction of the sum of the load carried by the truck or car, the weight of the truck or car itself, the weight of the platform and the weight of the cable paths connected thereto. The conveyor mechanism thus need only supply a fraction of the energy which would otherwise be necessary to move this latter total mass. It is possible to operate in a single track system with the workload operating in its track and the counterweight in its track.

According to a feature of the invention, the conveyor mechanism driving the cable has a rerouting drum looped by the or each cable and between the upper and lower passes of the or each cable or has individual pulleys or wheels for each cable, the cable returning after being looped around this drum or the rerouting pulleys. The conveyor mechanism or drive may be of the Koepe type.

Preferably the rerouting drum is connected with the conveyor mechanism with a variable spacing therebetween, the system including a cable magazine containing a supply of cable for lengthening of the travel of the cable. With increasing depth of excavation and thus with increasing travel distance, the cable must be effectively lengthened so that there is a progressive increase in the cable weight as well.

For deeper excavations and thus the need to displace the platform to increasingly greater depths, it is merely necessary to release the rerouting drum anchored to the foundation and move it to a new position closer to the drum of the drive mechanism. The movable drum is then fixed at this new position. The rerouting drum can have a diameter of, for example, 9 m and can have journal blocks which are shiftable linearly on respective tracks. The force required for the shifting can be developed hydraulically and when a number of cables are provided for the elevator, a corresponding number of rerouting pulleys can be used instead of a single rerouting drum. For increased output of the mine, a multiplicity of such inclined elevators can be provided in the funnel-shaped excavation in spaced apart relationship therein.

According to a preferred embodiment of the invention, the rerouting drum or assembly of pulleys or rerouting roller can be inclined to the horizontal and each cable can pass around the cable drum of the drive mechanism with double looping so that each cable has at least two turns on the cable drum in a pair of grooves. This permits the drive to be a conventional Koepe conveyor machine because, with the double looping, sufficient friction against the cable drum is achieved to enable the cable system to move extremely large loads which could not be handled by a Koepe drive machine with a single 180° looping of the cables. The double looping provides cables in two grooves to prevent slippage under the high weights which must be transported. Alternatively a drum drive machine would have to be very large and hence very expensive to handle lengths of cable which can exceed 700 m, multiple cables of such length, and the loads coupled to them. The inclined orientation of the rerouting roller or the individual pulleys enables the double looping of the or each cable without danger that cross over regions will bring about contact of upper and lower cable passes.

In that connection, the upper pass and lower pass cable pulleys are offset vertically relative to the cable drum of the drive machine. The upper cable stretch and the lower cable stretch pass tangentially onto the rerouting roller and from the latter without interference of the oppositely travelling passes with one another.

According to a further feature of the invention and in another embodiment thereof, to provide a greater degree of looping of the cable around the drum or pulley of the drive mechanism and thus affording increased friction force between the cable and cable carrier to allow large load ratios between the traveling platform cable and the counterweight cable, the upper and lower cable pulleys are laterally offset with respect to the drive machine and preferably offset from one another oppositely. This arrangement can permit a looping of about 240° around the cable drum or pulley of the drive. The cable coming from the platform passes over the upper cable pulley and can meet the groove of the cable on the drive machine at a slight angle, e.g. of 0.7 grad.

This deflection is obtained in spite of the fact that the cable pulleys have their axis parallel to the axis of the drive machine and perpendicular to the axis of displacement by laterally offsetting the upper and lower cable pulleys with respect to the center of the cable guide on the drum. After a 240° looping in the groove of the cable carrier on the drive machine, the cable is deflected again at an angle of 0.7 grad in the opposite direction to the lower cable pulley and to the latter toward the counterweight. Since the center of the cable of the lower pulley is thus slightly offset from the center of the cable on the drive machine, at the crossing point between the oncoming and outgoing cable a substantial separation can be provided so that the passes do not interfere with one another. The angle or degree of offset thus contributes to the requirement for noninterfering cable travel even in the case of jumping of the cable. All of the cables in all of the regions which are equivalent can be parallel to one another.

The slight oncoming and outgoing angle which would otherwise be required at the cable pulleys can be eliminated in that the cable pulley axes can be inclined to the foundation. The lateral shifting of the cable centers on the one hand between the upper cable disk and the drive and on the other hand between the drive and the lower cable disk can be compensated by connecting the cables to the counterweight asymmetrically with respect to the center of gravity of the latter.

According to a further feature of the invention the cable magazine to compensate for increasing depth by effectively lengthening can be provided on the platform or the counterweight in the form of a windlass drum which is looped by two or more turns of the or each cable. Sufficient friction is thus obtained by the plural looping in that the plural looping has been found to provide a sufficient level of friction. The multiple turns for cable allow sufficient cable to be stored for usual mining operations. With a diameter of the windlass drum of 3 m, cable useful lives of two years with increases in depth of say 15 m per year may require three additional turns per cable. The arrangement of a windlass drum as the cable supply has the advantage that the weight of the windlass drum and the cable supply can be part of the counterweight which would otherwise have to be weighted additionally.

According to a feature of this aspect of the invention, the windlass drum is mounted rotatably on a support frame or has a shaft common to a number of windlass drums mounted don the support frame. If required the requisite cable supply can be provided in readiness and mounted with the support frame or on the support frame. The windlass drums can be driven by a motor via a chain drive although the pay out of an additional cable supply is naturally done in load-free state of the cable.

In a multiple cable arrangement, each windlass drum can be provided with a hydraulic cylinder and locking device which can serve to take up the load and thus relieve the motor and chain transmission from the load when the load is reapplied.

This mechanism can operate following rotation of the drum to pay out (or take up) excess cable or to engage the drum for retensioning of the cable. The hydraulic cylinder and locking device can be mounted on the support frame. The cable, the hydraulic cylinder and the locking mechanism can extend in the force application directly and can relieve the drive of the windlass drum from cable tension forces as has been mentioned.

According to still another feature of the invention, the traveling platform is formed in two parts from a frame and a removable bottom which is seated on this frame. This feature increases the transport reliability since the bipartite configuration enables the bottom with the considerable weight of the loaded truck to be held both in upper and in lower positions for loading and unloading relative to the elevator without lengthening the cables by loading or shortening the cables by unloading. In other words the bottom can be locked to the foundation, according to the invention, independently of the traveling frame in upper and lower positions of bottom and with precision.

For this purpose, at the four corner regions of the bottom, recesses or notches are provided into which upper and lower retaining pawls, controlled by appropriate signals, can be swung. As soon as the platform has been slowed down and shortly before it is brought to standstill, the end position which can be signalled by limit switches or other electrical monitoring means can cause the retaining pawls to be swung into the travel path and swung either above or below the bottom to engage the latter. Further lifting or lowering is then not possible even when, for example, the support frame continues to travel.

According to a further feature of the invention, at the four corners of the bottom there are holes in which pins of the traveling frame engage, the holes and the pins being inclined in the travel direction. At each of the four corners two mechanically independent retaining pawls can be provided which engage over or under the removal bottom and which are free to move only when the friction force of the bottom against the respective pawl is relieved. When the pawls are all swung inwardly and the bottom is pressed against the upper pawls, a signal instructing the pawls to swing outwardly will only be effective on the pawls lower whereas the reverse is true when the weight of the bottom is on the lower pawls. When of course the frictional contact is relieved, the pawls which have been frictionally retained are permitted to swing.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
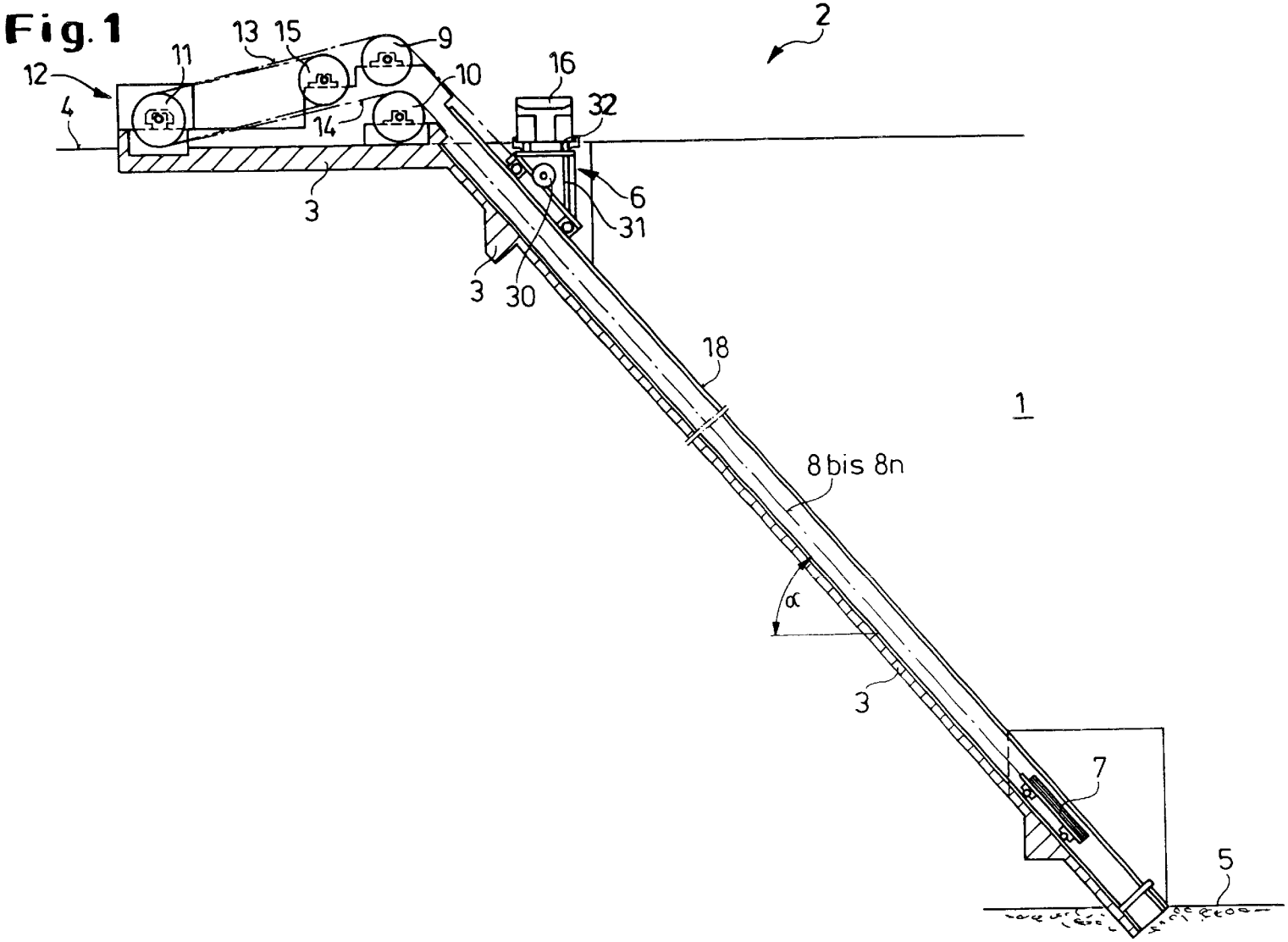
FIG. 1 is a side elevational view, partly in section showing the basic elements of an inclined conveyor in accordance with the invention.

FIG. 1 shows one of a number of inclined elevators 2 which can be provided in a funnel-like excavation and which serve to advance the excavation downwardly by removing the mined material, forming stopes and a wide mouth for the open-cut mine. The open-cut or funnel-shaped excavation as a whole has been represented at 1 and the inclined elevators 2 can be identical to one another, The elevators are themselves mounted upon concrete foundations 3 and extend from the ground surface or grade 4 to the base 5 of the funnel which may be of a depth of say 100 m from the grade surface 4. The elevators 2 can be inclined at an angle a at about 50° and can be spaced around the excavation to minimize travel of the cars onto the platforms of these elevators at the excavation levels.

Each of the elevators has a traveling platform 6 and a counterweight 7 which move oppositely up and down the elevator via cables 8, $\mathbf{8}_1 \ldots \mathbf{8}_n$, the cable ends being fixed on the one hand to the traveling platform 6 and on the other hand to the counterweight 7.

The cables 8–$\mathbf{8}_n$ run over cable pulleys 9 or 10 and are looped around a cable drum 11 of a conveyor mechanism or drive machine 12 fixed at grade level. Each cable has upper and lower cable passes 13 or 14 running in opposite senses to the cable drum 11.

The traveling platform 6 can carry cars or trucks 16 which can be loaded with the mined material and can be secured on the platform to transport the mined material upwardly as shown in FIG. 1 from the base of the funnel-shaped excavation to the surface while the counterweight 7 travelled into its lowermost position. The traveling platform 6 and the counterweight 7 move on wheels 17 riding on rails 18 (FIG. 7) on the inclined base.

Figure 5:
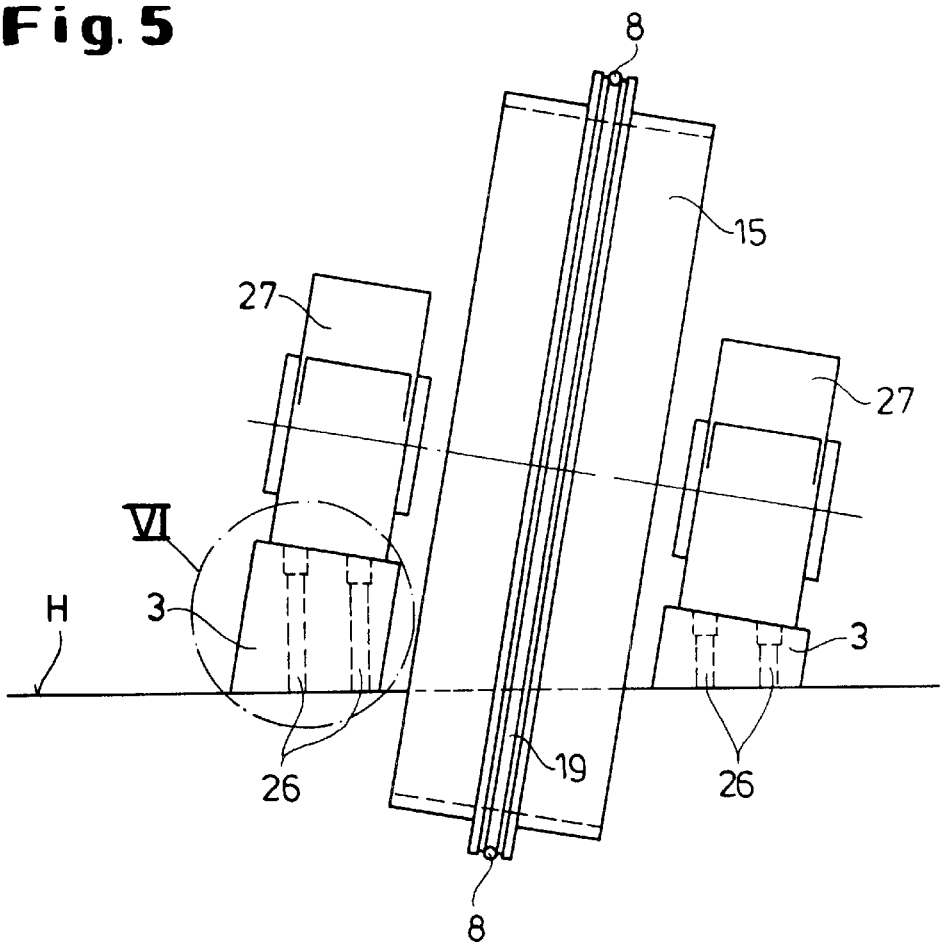
FIG. 5 is a detail of the cabling system with an exaggerated inclination of the rerouting drum.

A rerouting drum is provided opposite the cable drum 11 and receives the cables 8–$\mathbf{8}_n$. This rerouting drum can also be formed as a series of individual pulleys for the respective cables 8–$\mathbf{8}_n$. The rerouting drum or set of pulleys 15 serves on the one hand to increase the frictional engagement of the cables against the cable drum 11 which are looped at least twice by each cable and to spread the load applied to the foundation. For this purpose, the rerouting drum 15 is inclined to the horizontal plane 5 on the foundation 3 (FIGS. 3 and 5). The cable pulley 9 which is vertically upwardly offset from the cable drum 11 (FIGS. 1 and 2), receives the upper pass of the respective cable 8–$\mathbf{8}_n$ extending tangentially from the cable drum 11. In FIGS. 3 and 5, for simplicity of illustration, only a single cable groove 19 is shown for the rerouting member 15 although it will be understood that the plurality of cables 8–$\mathbf{8}_n$ will pass around the rerouting drum or assembly of pulleys as well following a first looping of the cable drum 11. In other words each cable can be first looped around the cable drum 11 and then pass around the rerouting drum 15 back to the cable drum 11.

Figure 3:
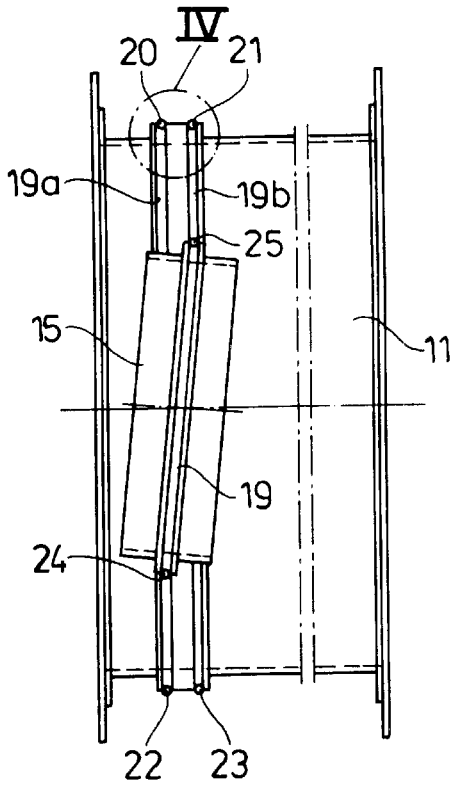
FIG. 3 is a section along the line III—III through a corresponding structure with exaggerated inclination and differences in diameters of the cable drum of the conveyor mechanism and the rerouting rollers.
Figure 4:
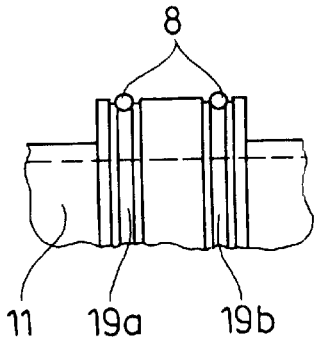
FIG. 4 is a detail of the region IV of FIG. 3 drawn to a larger scale.

FIG. 4 shows that each loop around the cable drum 11 lies in a respective groove 19*a*, 19*b* for such cable. In FIG. 3 for simplicity as well, only a single groove 19 and the pair of grooves 19*a* and 19*b* for one cable 8 have been shown. Corresponding grooves being provided for each of the other cables. Each cable 8–8$_n$ loops the drum 11 at least twice.

Figure 2:
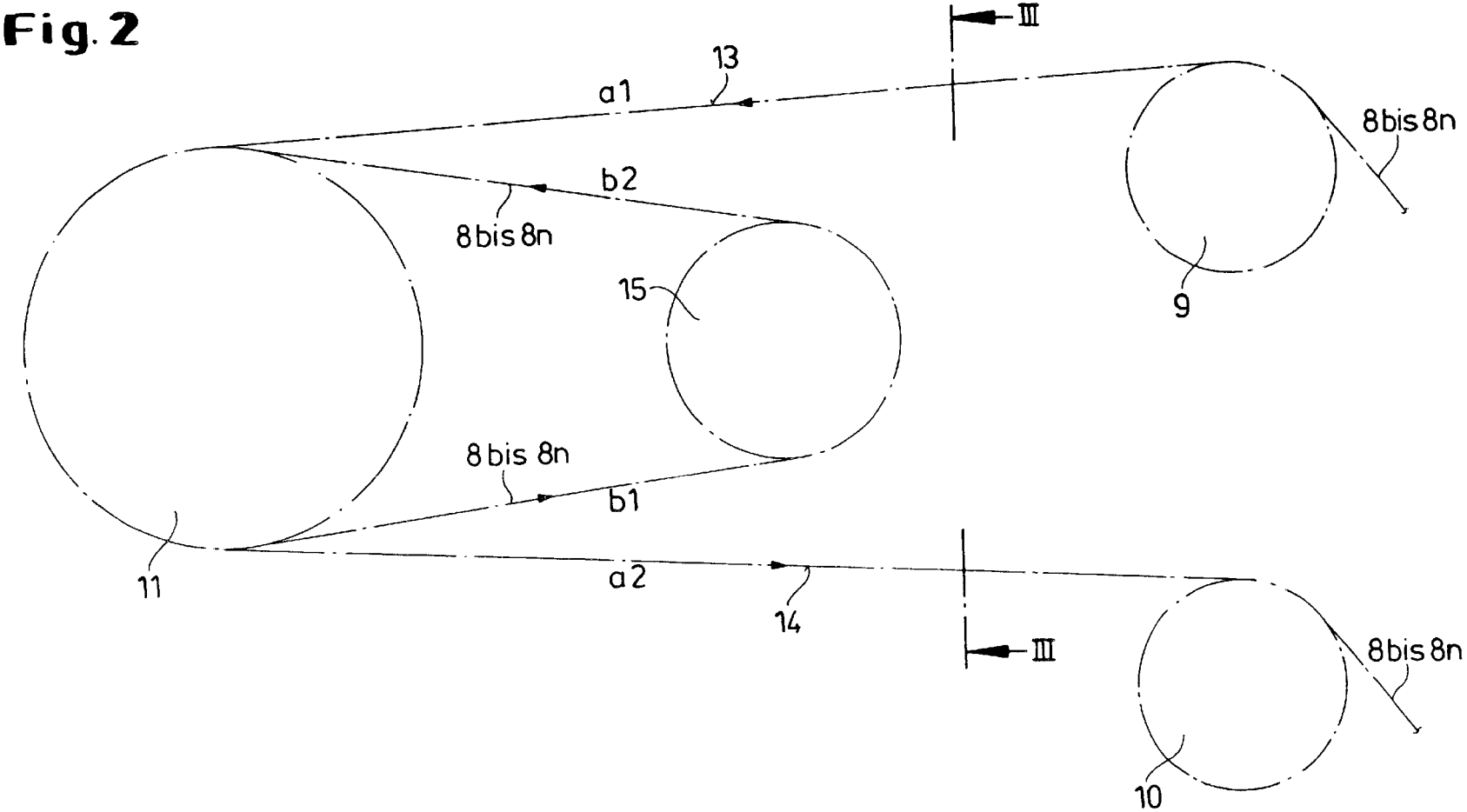
FIG. 2 is a detail of structure at the grade level showing the cabling pattern for the conveyor of FIG. 1 and with different diameters of the pulleys and the drum.

As can be seen from FIG. 2, the cable 8 passes over the cable pulley 9 (from the platform 6) in a pass al tangentially onto the cable drum 11, then loops the latter through about 180° to form the cable pass b1 running tangentially to the rerouting drum 15 passes tangentially from the rerouting drum in a pass b2 back to the cable drum 11 and after traveling 180° around the cable drum 11, extends at a2 tangentially onto the cable pulley 10 to the counterweight 2.

In FIG. 3 the points at which cable 8 arrives from the cable pulley 9 and from the rerouting drum 15 have been identified at 20 and 21 and the points at which the cable 8 leaves the rerouting drum for the cable pulley and the rerouting drum 15 are designated at 22 and 23 while the point at which the pass b1 meets the rerouting drum is shown at 24 while the point at which the pass b2 leaves the routing drum 15 is represented at 25.

Figure 7:
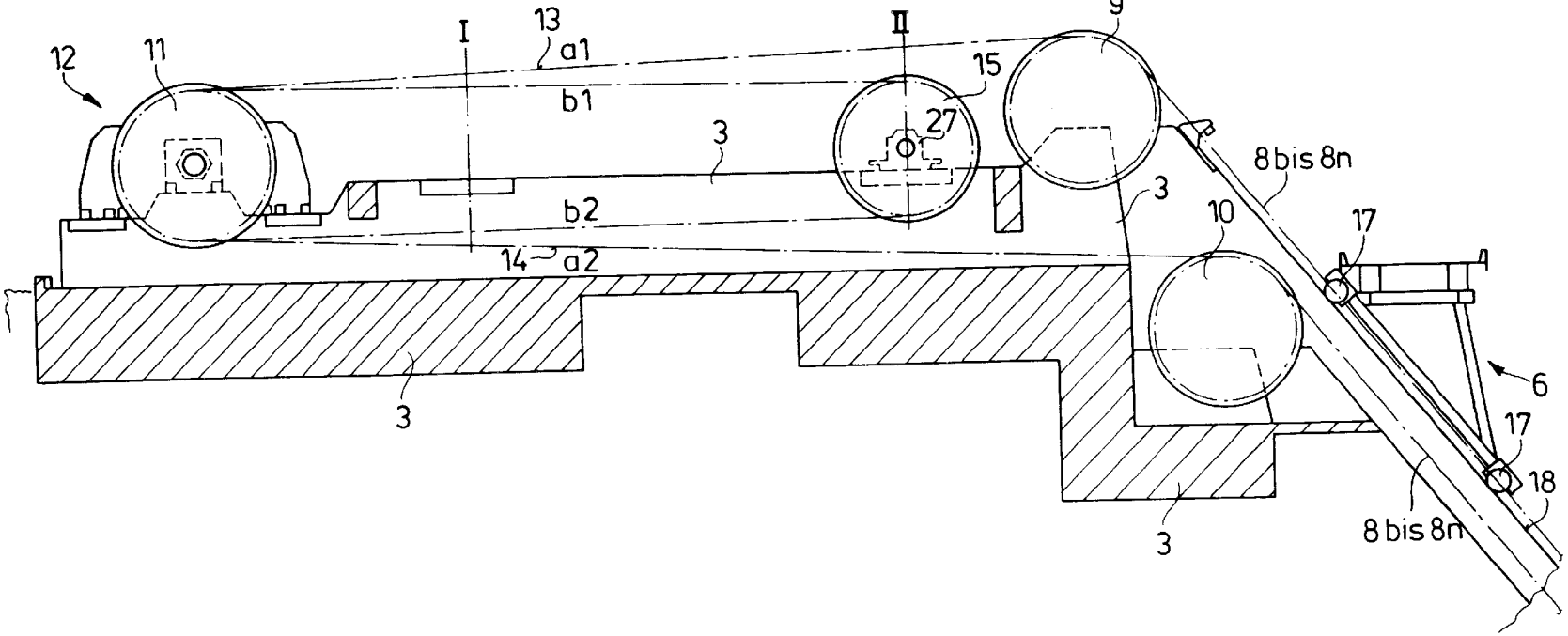
FIG. 7 is a side view drawn to a larger scale in FIG. 1 of the cabling system at the mouth of the excavation illustrating another feature of the invention.

The rerouting drum 15 can be used as a cable magazine and in this case its distance from the drum 11 of the drive mechanism 12 can be varied as has been shown in FIG. 7. For an increase in the effective cable length with depending of the mining excavation, the rerouting drum 15 can be moved from position II into position I, at a very short distance from the cable drum, so that the length of the cable can effectively double the stroke of the platform.

The foundation 3 is, of course, previously provided with fixing points, for example, the positions I and II, at which the journals 27 for the rerouting drum or pulleys can be anchored. It is thus only necessary to release the anchorage of the rerouting drum 15 and to move it to the new position to lock it in place again, usually with bolt-type fasteners.

Figure 6:
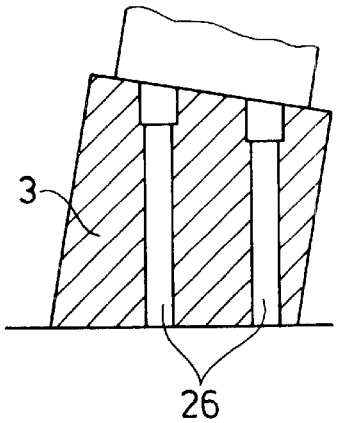
FIG. 6 is a section through the region VI of the apparatus of FIG. 5.

To displace the rerouting drum 15 after release of the anchorage to the concrete foundation 3, hydraulic lines 26 can be provided as has been shown in FIGS. 5 and 6, the source of the hydraulic fluid under pressure having not been shown. The journal 27 can be shifted along rails from one position to the other and, where force is required for this purpose, hydraulic cylinders can be utilized.

Figure 8:
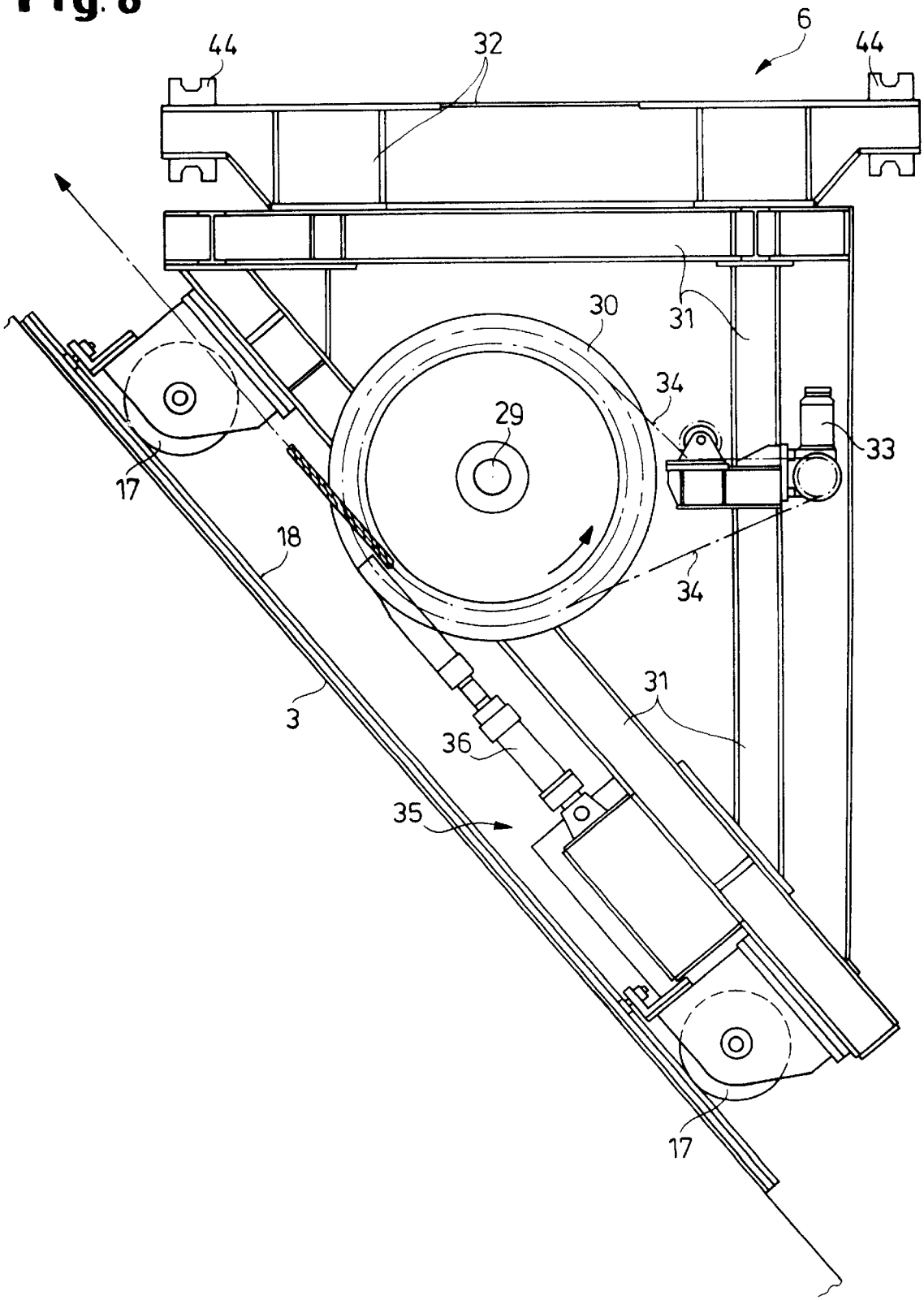
FIG. 8 is a side view of a detail of the inclined elevator showing features of the traveling platform.

A variant of the cable magazine has been shown in FIG. 8.

Figure 9:
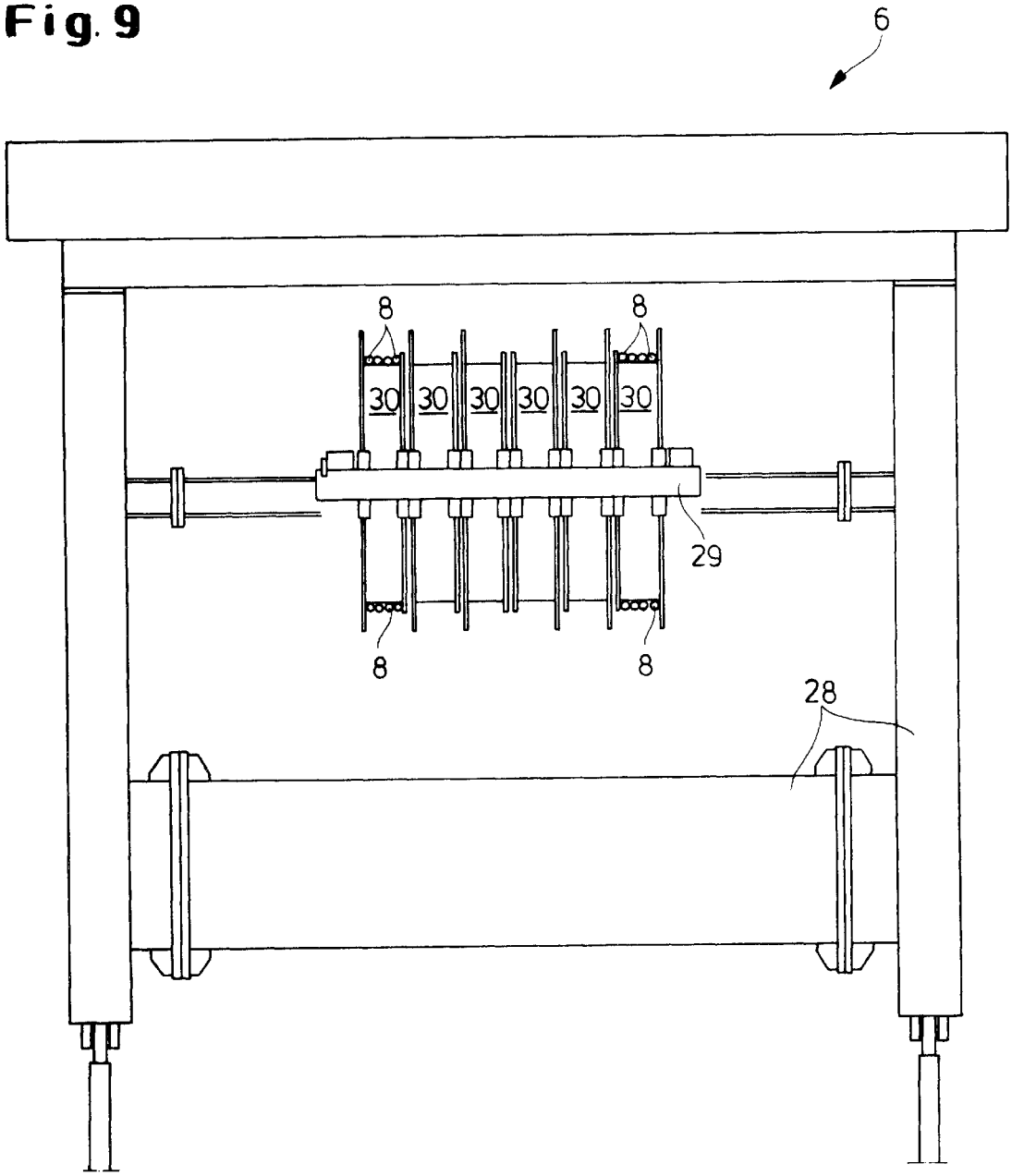
FIG. 9 is a front view of the platform of FIG. 8 in which a windlass type of cable magazine is provided.

In this figure, on a common shaft 29, a multiplicity of windlass drums 30 are rotatable in a support frame 28, the number of windlass drums 30 being equal to the number of cables 8–8$_n$ coupling the platform with the counterweight. Reference may be had to FIG. 9 which shows a plurality of such windlass drums.

The support frame 28 with its windlass drums 30 is disposed in the traveling frame 31 of the traveling platform 6 which has two major parts, namely, the traveling frame 31 and a removable bottom 32 which is mounted thereon. Alternatively, the cable magazine can be provided on the counterweight.

The widths of the cable drums 30 correspond to that required for the requisite cable supply and, as a rule, each cable drum 30 will permit the respective cable 8 to be looped therearound in a number of turns as has been shown especially for the two outermost windlass drums 30.

For paying out the requisite amount of cable, thereby permitting the greater travel of the platform, the windlass drums 30 are provided with a motor 33 and a chain drive coupling the motor with the windlass drums 30.

In addition, a load take up device 35 is provided to engage the windlass drums and for retightening of the cable. As can be seen from FIG. 10, the latter can include a repositioning device 37 and a hydraulic cylinder 36. The cables 8–8$_n$ in their new lengths are fixed and the drive 33, 34 relieved by this mechanism.

Figure 10:
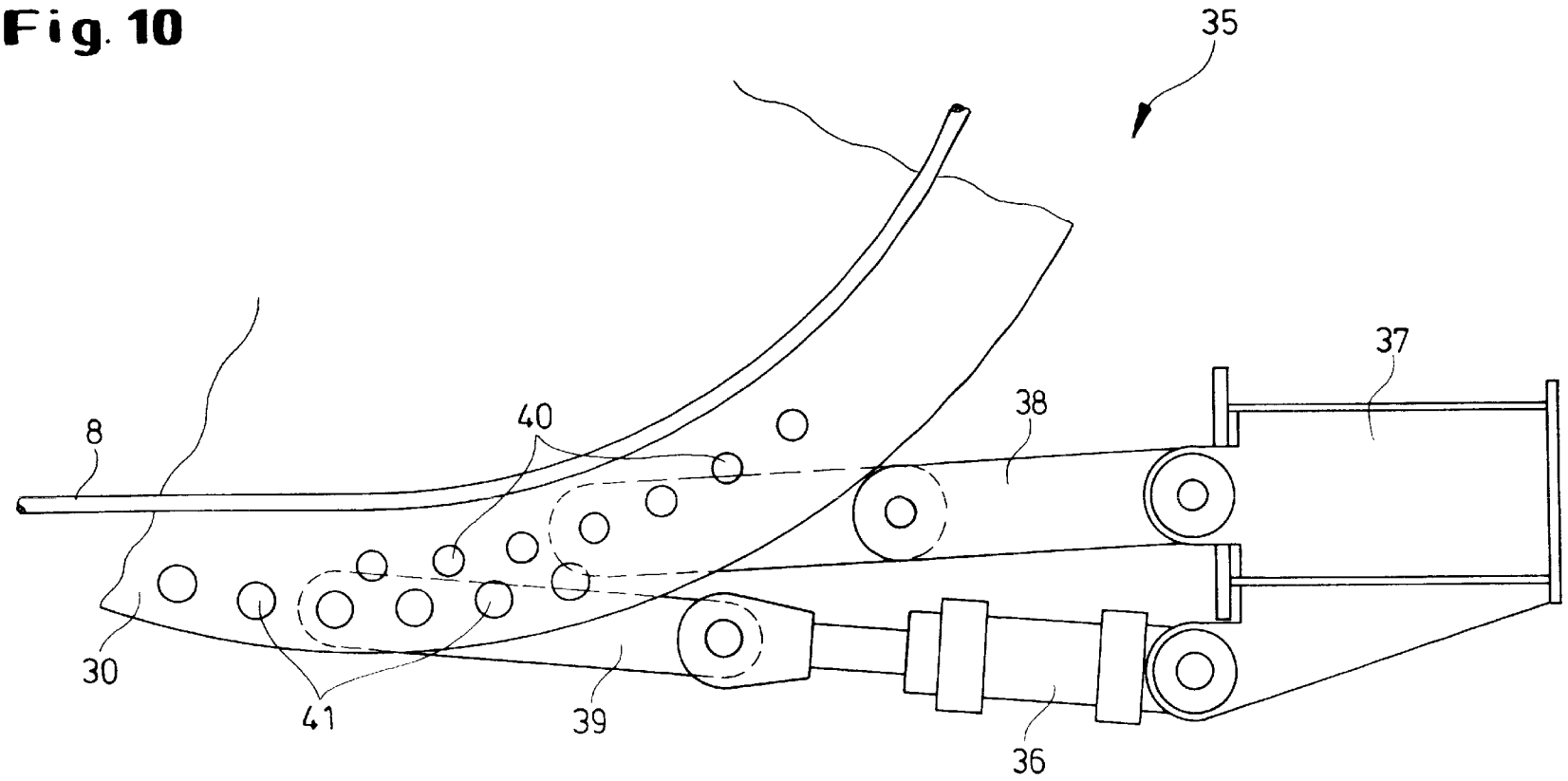
FIG. 10 is a detail of FIG. 8 showing a load takeup device for the cable magazine of FIG. 8.

As can be seen from FIG. 10, the hydraulic cylinder 36 and the locking mechanism 37 are connected by links 38 and 39 with the windlass drum 39 and for each of the lengths 38 and 39, a respective row of bores 40, 41 are provided along a part of a circle so that by changing the points at which the links 38 and 39 are pivotally connected to the drum 30, the effective links of the cable 8–8$_n$ can be changed, effectively foreshortened.

The pins which connect the ends of the links 38 and 39 to the selected bores 40 and 41 have not been shown. In operation, the pin connecting the links 38 with a hole 40 is withdrawn, the drum 30 is rotated to extend or reduce the effective length of the travel of the cable and hence of the platform, the hydraulic cylinder 36 permitting that adjustment, and the pin is then reinserted. When a major rotation or fraction of a rotation is required, the pin connecting the link 39 is withdrawn from the hole 41 and replaced in the hole when the rotation of the windlass drum 30 is completed. The holes 40 and 41 being selected to set the effective length of the cable desired.

To fix the replaceable bottom 32 on the frame 31 of the platform 6 (FIG. 8), at each corner of the platform 31 an arresting pin 42 is provided. The pins 42 are angled in the travel direction of the inclined elevator and engage in complementary bores 43 of the replaceable bottom 32 and hold the latter previously in position on the traveling frame 31.

The two part platform 6 has the advantage that the replaceable bottom 32 with the loaded truck or car 16 thereon can be held in place with precise positioning even in an emergency. For this purpose, at the four corners of the bottom 32, detent recesses or notches 44 are provided (see also FIG. 8) in which detent pawls 45 (FIG. 11) can engage. The pawls 45, which are shiftable between their end positions by cylinder 46 are responsive to locking and unlocking signals, can engage in the notches 45 and retain the bottom 32 against a lower pawl or rest 44. The positions of the pawls can be monitored by the control system. FIG. 12 shows the engagement of an upper pawl in its notch 44. When the pawls are retracted, of course, the bottom 32 can be removed.

Figure 11:
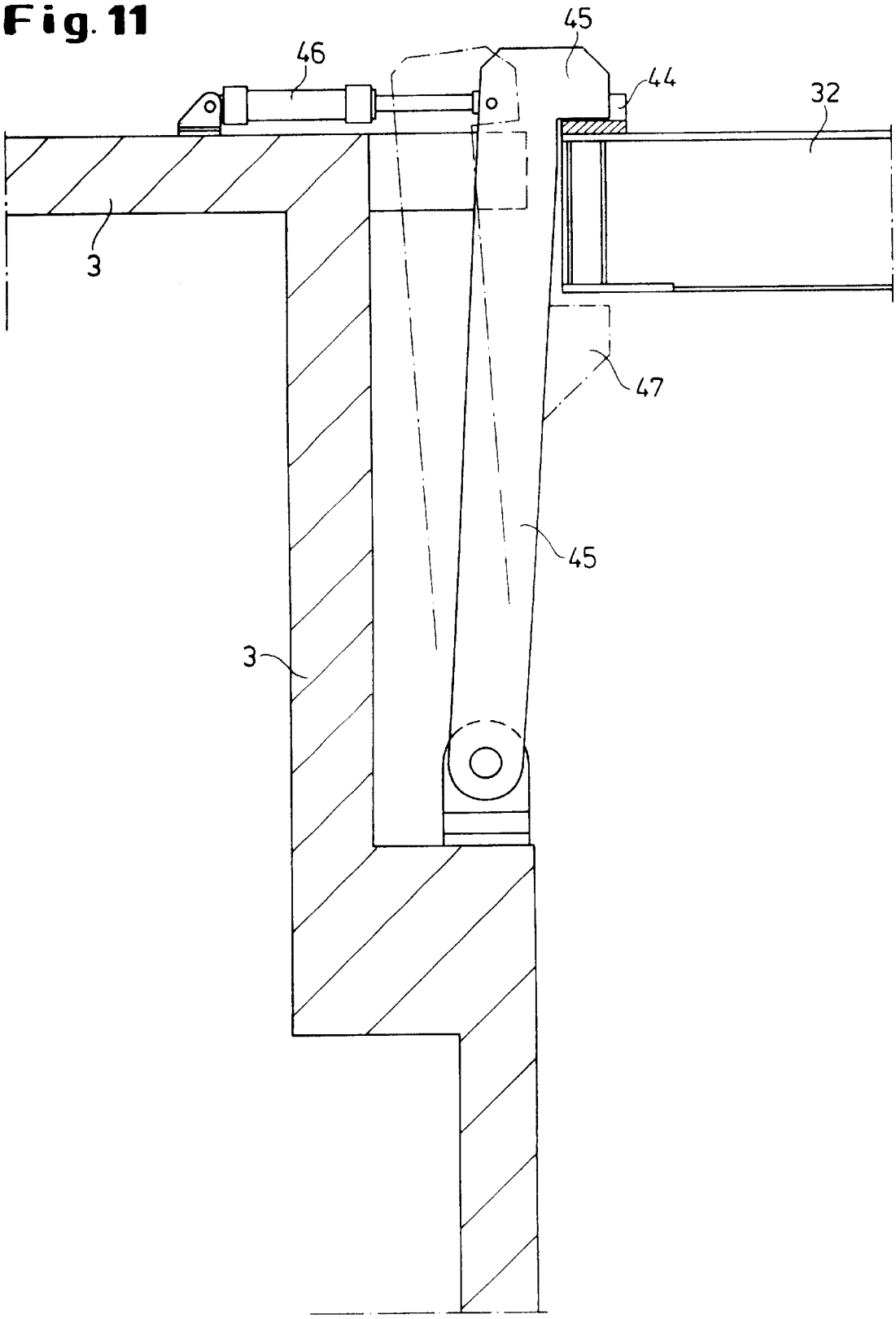
FIG. 11 is a side view of a holding pole at the upper end of the inclined elevator.
Figure 13:
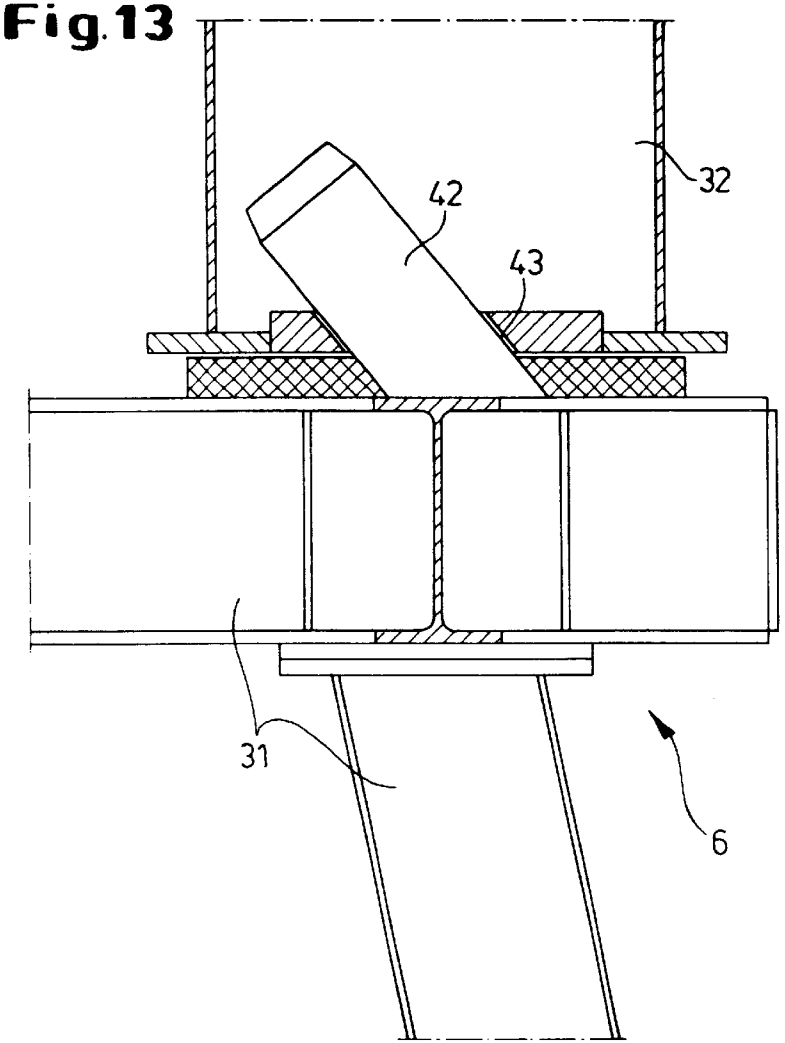
FIG. 13 is a detail, partly in section of an arresting pin as provided at each of the four corner regions of the removable bottom.
Figure 12:
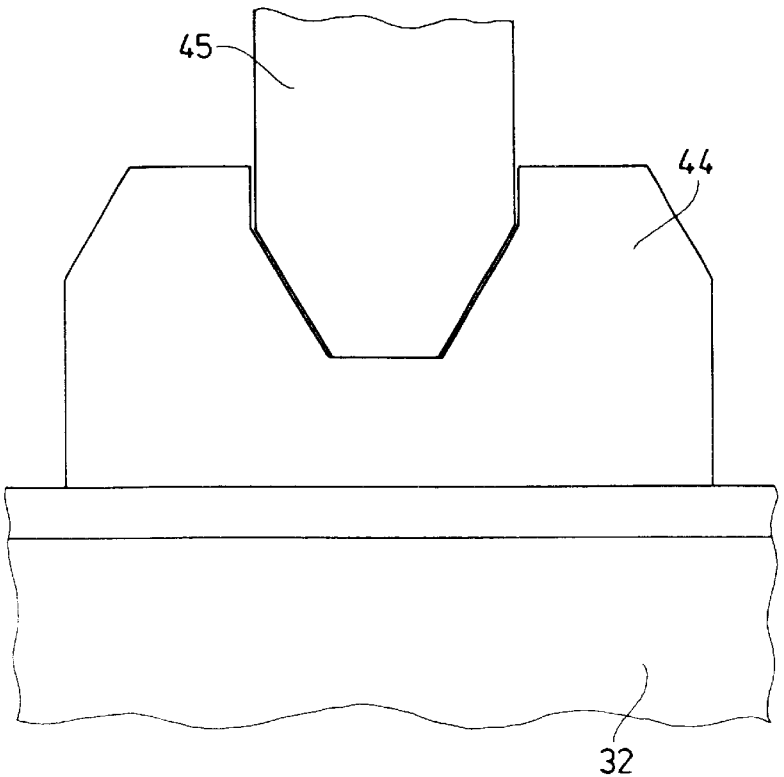
FIG. 12 shows the pole of FIG. 11 in its engaged position in front view.
Figure 14:
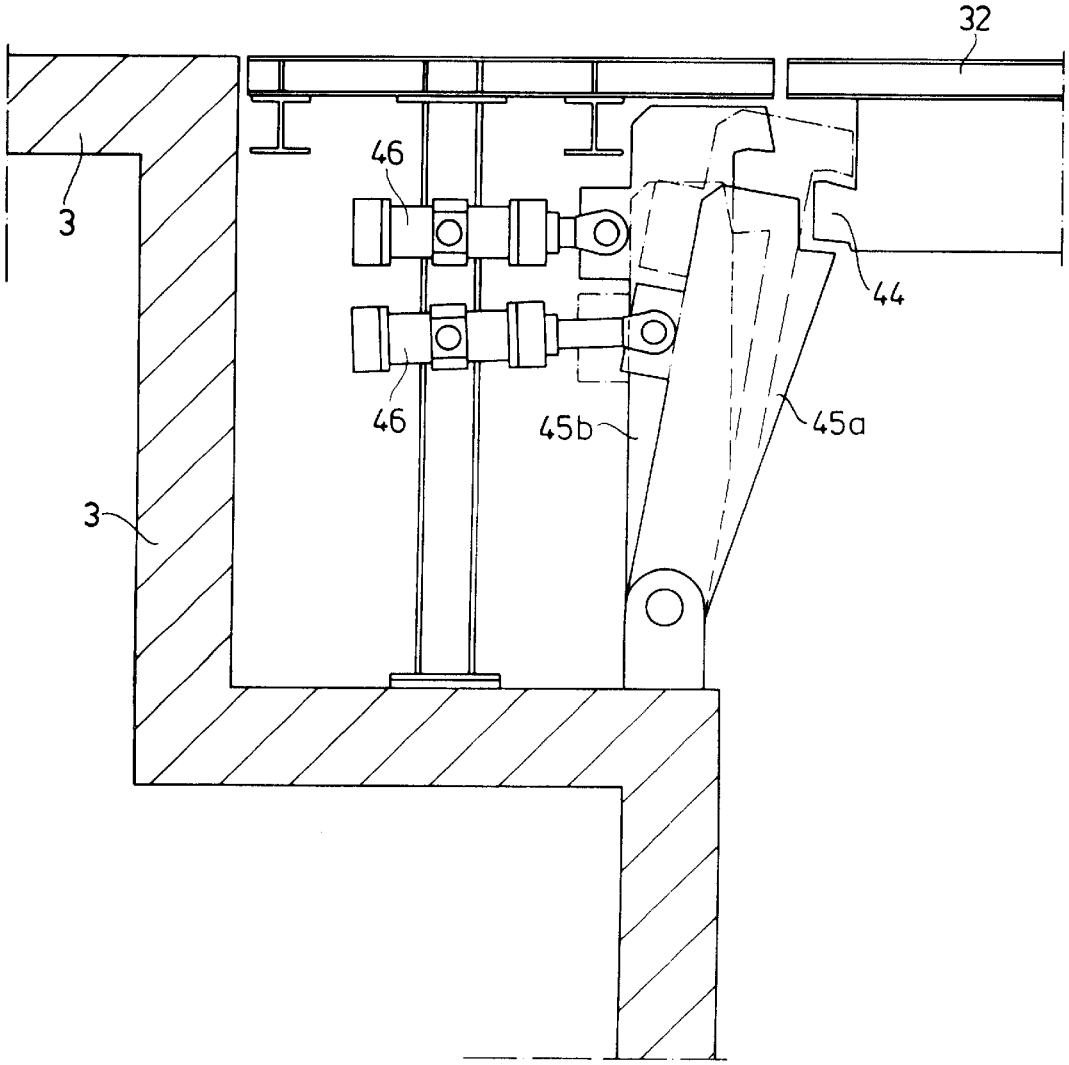
FIG. 14 is a view similar to FIG. 11 but of an alternative retaining pole arrangement as provided at each of the four corners.

FIG. 14 shows a modification of the pawl and detent system of FIG. 11 for the exact positioning from both top and bottom of the replaceable bottom 32. Here at each of the four corners, two detent pawls 45*a* and 45*b* are provided. The detent pawls 45*a* and 45*b* are operated by respective cylinder 46 independently of one another. Although all eight upper and all eight lower pawls can be simultaneously activated and swung together for fixing the bottom 32 for loading or unloading using a signal system which has not been illustrated. The pawls thus engage in corresponding recesses (see FIG. 12) in the bottom 32.

The pawls 45*a* and 45*b* defining the upper and lower end positions for the bottom 32 can operate as follows:

Upper end position.

The bottom 32 carrying a loaded truck or car is stopped with the aid of the signalling system at a defined position. All eight pawls are simultaneously actuated and swung inwardly. In this position the bottom 32 can be moved upwardly or downwardly through several cms (compare FIG. 14) until it comes to rest against either the upper or lower retaining pawls 45*a* or 45*b*.

After the loaded truck has left the replaceable bottom 32, since the cable tension has been reduced, the bottom 32 comes to rest against the upper pawls 45*b*.

The bottom 32 is again loaded. The cables are more strongly stressed. With the increase in stress, contact of the bottom 32 against the pawls 45*b* is terminated and thus all eight pawls 45*a* and 45*b* are free.

The renewed loading can, however, be so small that a contact with the bottom 32 and the upper pawls 45*b* holds the latter in. All eight pawls 45*a* and 45*b*, however, simultaneously receive the signal to swing outwardly. The pawls 45*a* which are intended to engage 26 bottom 32 from below then swing out immediately. The pawls 45*b* which are intended to engage the bottom from above, cannot however swing outwardly because of the frictional engagement with the bottom. A requirement for this operating state is that the hydraulic force be sufficiently small that it does not overcome the friction force.

The travelling platform, frame and bottom are moved downwardly and this movement causes the frictional contact to be removed so that the pawls 45*b* swing outwardly and a signal produced as a result to signal the disengagement of the body 32.

Lower end position:

The bottom 32 with the aid of the signalling system is stopped at a defined position, All eight pawls 45*a* and 45*b* are simultaneously actuated and swung in. In this position the bottom 32 can still move upwardly and downwardly until engaged by the upper or lower pawls. The platform is moved downwardly somewhat further where upon contact between the bottom 32 and the traveling frame is released. The bottom 32 rests on the lower pawls 45*a*. In this position the bottom 32 is unloaded and reloaded. It remains resting on the lower pawls 45*a*. A signal is then obtained to swing all eight pawls outwardly. The upper pawls, out of frictional contact with the bottom 32, swing outwardly immediately. The latter pawls 45*a* remain swung in since the hydraulic force of cylinder 46 is less than the friction force between the bottom and these pawls.

The traveling frame 31 is moved upwardly so that the bottom 32 is lifted and via pins 42 is again fixed on the traveling frame 31. With increasing displacement the lower pawls 31 are freed from frictional engagement and fall out. The result is a reliable engagement of the bottom 32 at grade level from transfer of trucks to and from the bottom and nevertheless simple transfer to and from the traveling frame 31. The pawls can be triggered simultaneously both for the upper and lower end portions and in spite of that, the end portions are defined.

Figure 15:
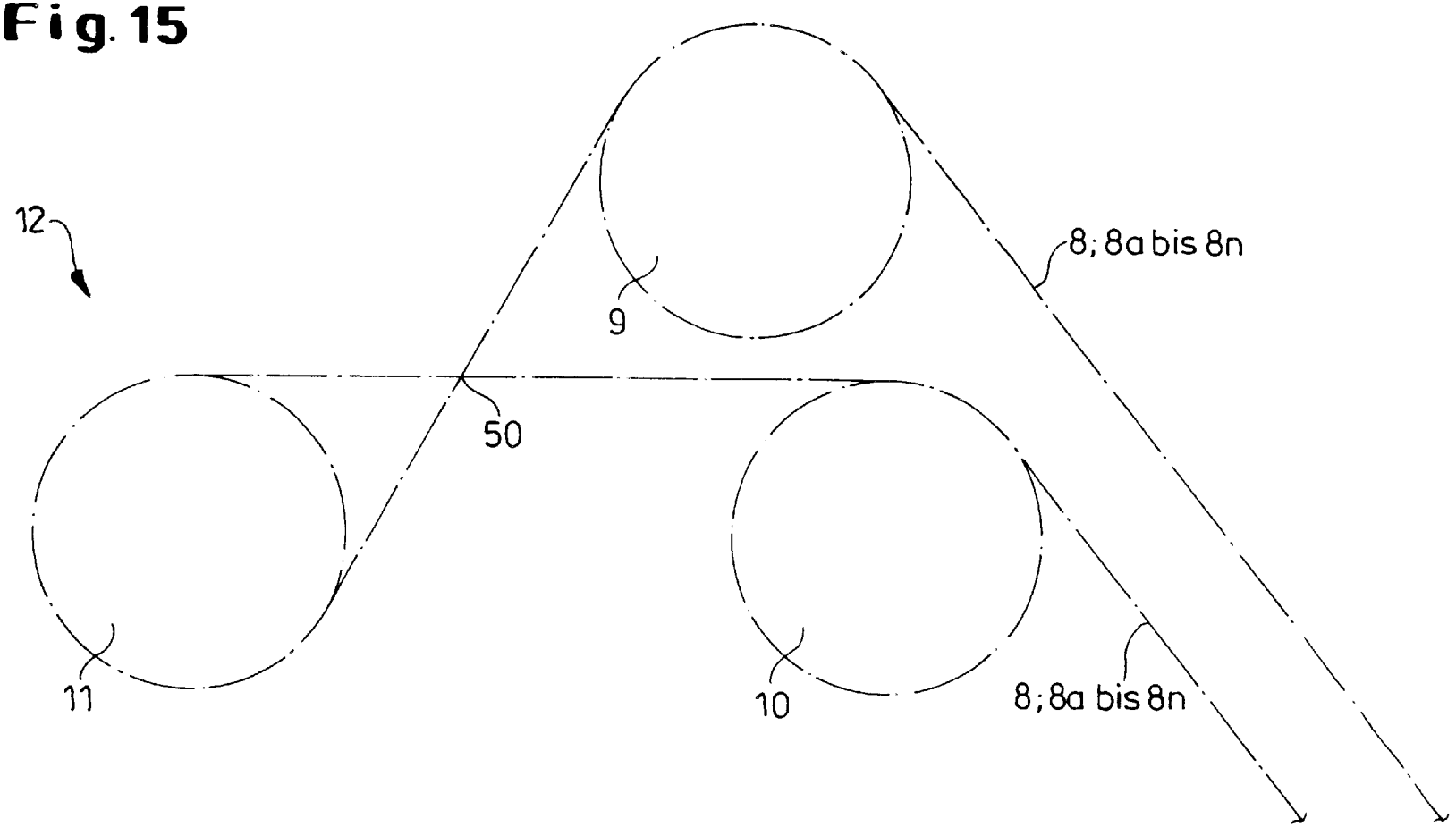
FIG. 15 is a detail of an alternative cable to that of FIG. 2 without a rerouting drum as provided in the system of FIG. 2.
Figure 16:
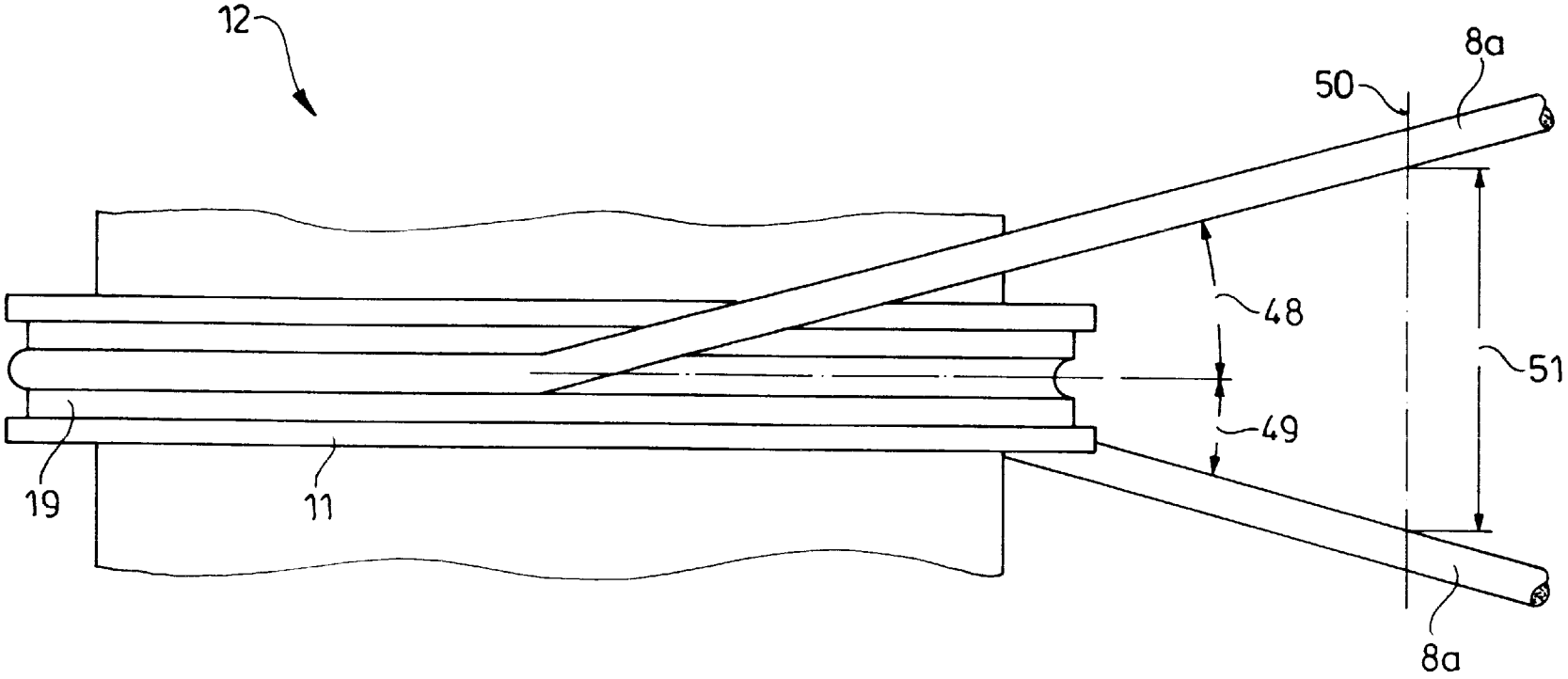
FIG. 16 shows a detail of the cable travel of FIG. 15.
Figure 17:
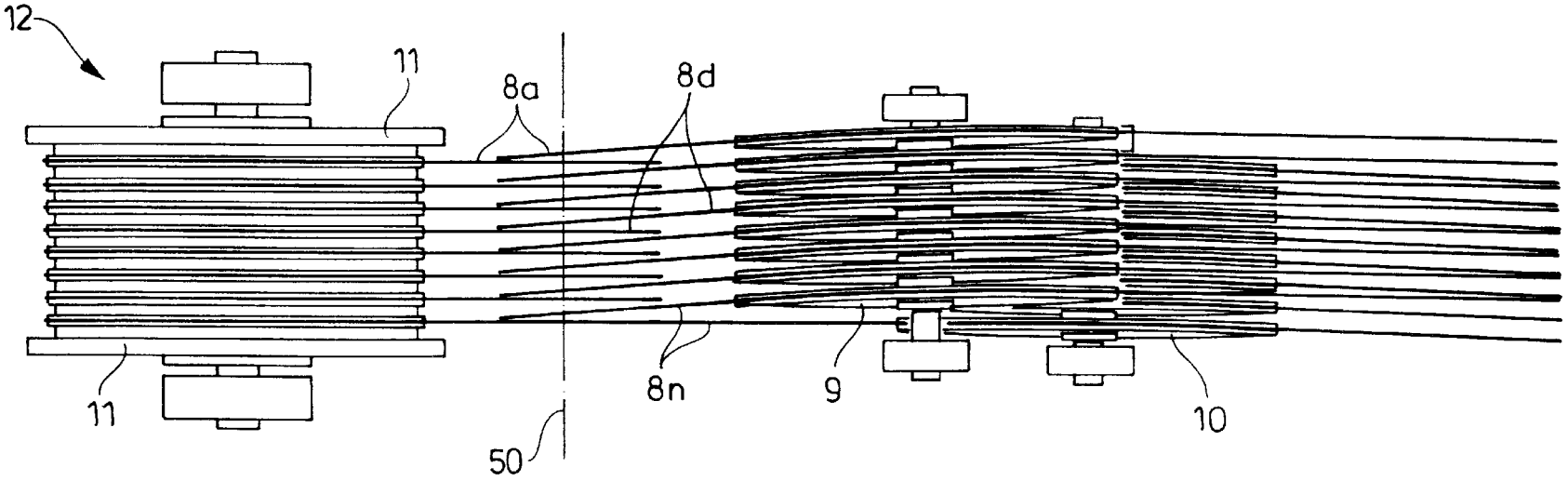
FIG. 17 is a plan view of a multicable system with cable travel in accordance with the principles of FIGS. 15 and 16.

In FIGS. 15–17, the cables are looped on the drum 11 of the mechanism through about 240° so that with reduced cable tension, a comparatively high friction force can be generated between the cable drum and the cable or a cable carrier on this drum, namely, a cable carrier such as the groove member 19 shown in FIG. 16 and the respective cable 8*a* through 8*n*. The cable pulleys 9 and 10 are here somewhat offcenter with respect to the conveyor mechanism 12 with its cable drum 11 as can be seen from FIG. 17. The cables 8 . . . $\mathbf{8}_n$ coming from the platform 6 or the trucks in the multicable arrangement of FIG. 17, pass firstly over the upper cable pulleys 9 and then at a small angle 48 over the grooved carriers 19 of the drum 11 and from the lower in the opposite sense over a small angle 49 to the lower cable pulleys 10 (see FIG. 16) to the cable ends connected to the counterweight at the cross over points 50 between the oncoming and outgoing cable, a relatively large cable spacing 51 (FIG. 16) is provided that prevents contact between the two passes of the cable.

We claim:

1. A conveyor apparatus for open-cut mining in a funnel-shaped excavation with removal of overburden and mined deposits, formation of stopes and increased width at an opening of the funnel-shaped excavation at grade level with increased excavation depth, said apparatus comprising:

an inclined elevator extending from an edge of said opening at grade level to said floor level;

a traveling platform riding on said inclined elevator and adapted to receive a truck to be filled with overburden or mined deposits;

at least one cable passing over separate upper and lower cable pulleys and having an upper pass of the cable extending to said upper cable pulley from said traveling platform and a lower pass of the cable extending from said lower cable pulley along said elevator;

a counterweight riding on said elevator and connected to said lower pass of said cable; and a conveyor mechanism operating at grade level at an upper end of said elevator and having a cable drum looped by a portion of said cable between said upper and lower cable pulleys, at least one of said platform and said counterweight having a traveling frame guided on said elevator and provided with a windlass drum around which said cable is windable in a plurality of turns, a plurality of said cables being provided, said traveling frame being provided with a support frame carrying a common shaft on which a plurality of said windlass drums are mounted, each of said windlass drums receiving a respective one of said cables.

2. A conveyor apparatus for open-cut mining in a funnel-shaped excavation with removal of overburden and mined deposits, formation of stopes and increased width at an opening of the funnel-shaped excavation at grade level with increased excavation depth, said apparatus comprising:

an inclined elevator extending from an edge of said opening at grade level to said floor level;

a traveling platform riding on said inclined elevator and adapted to receive a truck to be filled with overburden or mined deposits;

at least one cable passing over separate upper and lower cable pulleys and having an upper pass of the cable extending to said upper cable pulley from said traveling platform and a lower pass of the cable extending from said lower cable pulley along said elevator;

a counterweight riding on said elevator and connected to said lower pass of said cable;

a conveyor mechanism operating at grade level at an upper end of said elevator and having a cable drum looped by a portion of said cable between said upper and lower cable pulleys, at least one of said platform and said counterweight having a traveling frame guided on said elevator and provided with a windlass drum around which said cable is windable in a plurality of turns;

a hydraulic cylinder and a pin mechanism acting upon said windlass drum for controlling an effective length of said cable; and a motor and a chain coupling said motor with said windlass drum for driving said windlass drum.

3. A conveyor apparatus for open-cut mining in a funnel-shaped excavation with removal of overburden and mined deposits, formation of stopes and increased width at an opening of the funnel-shaped excavation at grade level with increased excavation depth, said apparatus comprising:

an inclined elevator extending from an edge of said opening at grade level to said floor level;

a traveling platform riding on said inclined elevator and adapted to receive a truck to be filled with overburden or mined deposits;

at least one cable passing over separate upper and lower cable pulleys and having an upper pass of the cable extending to said upper cable pulley from said traveling platform and a lower pass of the cable extending from said lower cable pulley along said elevator;

a counterweight riding on said elevator and connected to said lower pass of said cable; and a conveyor mechanism operating at grade level at an upper end of said elevator and having a cable drum looped by a portion of said cable between said upper and lower cable pulleys, said platform comprising a traveling frame and a removable bottom loosely resting on said traveling frame.

4. The conveyor apparatus defined in claim 3 wherein said traveling frame has at four corners thereof arresting pins engaging in said removable bottom and extending in a travel direction of said platform along said elevator.

5. The conveyor apparatus defined in claim 3 wherein at corner regions of said removable bottom, detent receptacles are provided into which signal-controlled retaining detents can be swung in a travel direction of said platform at upper and lower end positions of said platform.

6. The conveyor apparatus defined in claim 5 wherein at each of four corners of said removable bottom two retaining detents are provided including one detent engaging said bottom from above and a second detent engaging said bottom from below.

7. The conveyor apparatus defined in claim 6 wherein a total of eight upper detents and eight lower detents are provided and all of said detents are swung away from said removable bottom by a control signal.

8. The conveyor apparatus defined in claim 3 wherein said conveyor mechanism comprises rerouting means receiving said portion of said cable from said cable drum and returning said portion of said cable to said cable drum, said rerouting means comprising a rerouting drum looped by said portion of a plurality of cables or respective pulleys individual to a respective cable of a plurality of cables.

9. The conveyor apparatus defined in claim 3 wherein said upper and lower cable pulleys are vertically offset relative to said cable drum.

10. The conveyor apparatus defined in claim 3 wherein said cable drum is operatively connected to said conveyor mechanism with a variable distance between said cable drum and said conveyor mechanism.

11. The conveyor apparatus defined in claim 3 wherein said upper and lower cable pulleys are laterally offset from said conveyor mechanism.

* * * * *